US007207453B2

(12) United States Patent
Rossi

(10) Patent No.: US 7,207,453 B2
(45) Date of Patent: Apr. 24, 2007

(54) CLOSURE AND A CONTAINER FOR PACKING PRODUCTS

(75) Inventor: Roberto Amarante Rossi, Santana do Parnaiba (BR)

(73) Assignee: Alcoa Aluminio S/A, Barueri-SP (BR)

( * ) Notice: Subject to any disclaimer, the term of this patent is extended or adjusted under 35 U.S.C. 154(b) by 1 day.

(21) Appl. No.: 10/690,714

(22) Filed: Oct. 22, 2003

(65) Prior Publication Data

US 2004/0129668 A1 Jul. 8, 2004

(30) Foreign Application Priority Data

Oct. 23, 2002 (BR) ..... 0204357

(51) Int. Cl.
*B65D 53/00* (2006.01)

(52) U.S. Cl. ..... 215/344; 215/252

(58) Field of Classification Search ..... 215/344, 215/343, 252, DIG. 1, 341, 345
See application file for complete search history.

(56) References Cited

U.S. PATENT DOCUMENTS 4,090,631 A * 5/1978 Grussen ..... 215/329
4,276,989 A * 7/1981 Hicks ..... 215/270
4,489,845 A * 12/1984 Aichinger et al. ..... 215/329
4,907,709 A * 3/1990 Abe et al. ..... 215/252
5,275,287 A * 1/1994 Thompson ..... 215/344
5,725,115 A * 3/1998 Bosl et al. ..... 215/252
5,803,286 A * 9/1998 Pfefferkorn et al. ..... 215/307
6,338,414 B1 * 1/2002 Schellenbach ..... 215/252
6,679,395 B1 * 1/2004 Pfefferkorn et al. ..... 215/307
6,695,161 B2 * 2/2004 Kano et al. ..... 215/341
6,889,857 B2 * 5/2005 Francois et al. ..... 215/344

* cited by examiner

*Primary Examiner*—Lien M. Ngo
(74) *Attorney, Agent, or Firm*—Alston & Bird LLP

(57) ABSTRACT

A closure, particularly for use on liquid-packing containers, comprising a first substantially circular portion from the periphery of which a second substantially cylindrical portion projects substantially orthogonal to the first portion, the closure comprising a sealing system provided with a first sealing element associated with the first portion and second and third sealing elements associated with the second portion, the first, second and third sealing elements cooperating with the packing container. The first and the third sealing elements provide sealing by deformation when the closure is applied to the container. The second sealing element provides sealing by direct compression when the closure is applied to the container.

13 Claims, 2 Drawing Sheets

CLOSURE AND A CONTAINER FOR PACKING PRODUCTS

BACKGROUND OF THE INVENTION

1) Field of the Invention

The present invention relates to a closure, particularly for use on containers for packing liquid products, especially carbonated beverages, as well as to a container for packing products, especially carbonated beverages, which comprises the closure aimed at herein.

2) Description of Related Art

Conventionally the packing of carbonated beverages, such as soft drinks in general, is problematic due to the high pressure inside the packing containers, such as bottles or cans.

Considering that nowadays, specifically in the case of bottles, there is a predominance of those that enable one to consume only a part of the product, the old metallic caps that were removed with a bottle-opener and did not allow one to close the bottle afterwards tend to disappear, notably in the field of soft drinks.

By virtue of the characteristics of packed carbonated beverages, there has always been the objective of conceiving a closure that could enable one to maintain the levels of gas in the beverage, even after successive openings, so as to ensure the flavor of the product as long as possible.

Therefore, the closure of a carbonated-beverage bottle should meet a number of functioning requirements that are extremely difficult to reach, mainly because their manufacturing costs should be kept as low as possible, that is to say:

1) first of all, the closure should bear a high pressure existing inside the battle, without presenting gas leakage and consequent decrease in pressure before the opening. This internal pressure may reach very high values, if the bottle is placed in the sunshine or in other places where the temperature is high, and/or in the event of the bottle being successively shaken, a situation in which a portion of gas, which was dissolved in the beverage, now occupies the empty space inside the bottle.

2) Secondly, the closure should have one or more sealing elements, which enables it to continue to prevent leakages of gas, even after successive openings of the bottle, in order to bring about a partial consumption of the beverage packed therein without a considerable loss of flavor.

3) Thirdly, evidently the closure should prevent leakage of liquids under any condition of use that is not an exception to the situations foreseen in design.

In an almost universal way, carbonated-beverage bottles have a threaded neck, to which a screwable closure is associated, which may be opened and closed many times. However, in order to guarantee the inviolability of the beverage between the place of manufacture and the moment at which the consumer opens the bottle, virtually all the closures have a anti-tamper seal, the functioning principle of which is based on the weakness of a determined region of the closure, so that, when the latter is unscrewed for the fist time, the weak region present an at least partial or visible break, which clearly indicates that the bottle has been opened.

Until now, the best closures for this kind of use are the so-called 2-piece closures, which, in addition to the carcass material, also have another constituent called "sealing", the plastic matter of which is usually elastomeric and flexible in order to provide a more accurate effect of accommodation on the bottle neck, bringing about a safer and more effective sealing. The practice of the industry is to use the 2-piece closures in applications where one requires the best tightness possible, which is exactly the case of the packing of carbonated beverages. Although there are carbonated-beverage bottles using single-piece closures, in general the closures that have a sealing are the best choice, since it provides the best retention of gas inside the beverage. However, the single-piece closures are, in general, more economical, less expensive, and one should always try to find the optimum point between the cost and the benefit.

Within this scenery, a number of inventions have been made lately with a view to obtain a single-piece closure capable of being successfully applied to carbonated-beverage bottles. Some of these inventions show the error of incrementing too much the mass of plastic matter (weight) of the closure in order to have a robust and efficient sealing system, which, however, entails extra costs that end up by making the project more expensive than that of a two-piece closure. In a general way, the objective is to develop a single-piece closure having an optimum point between its cost and its performance in retaining gas, which is a great advantage for the sector of carbonated-beverage industry.

It should be reminded that the single-piece closures are those that have a single constituent, that is to say, the matter that composes it is single and is the one that forms its carcass as a whole.

With a view to achieving the above objectives, a single-piece closure was developed and disclosed in U.S. Pat. No. 5,259,522 for use on packages, which comprises a substantially circular upper wall from which a cylindrical side wall provided with inner threads extends.

This closure also has two sealing elements comprising a relatively rigid annular support and a flexible sealing lip, which are positioned internally on said cylindrical side wall.

When the closure is screwed onto the bottle-neck, the sealing lip deforms in contact with the outer surface of the latter, while the relatively rigid annular support maximizes or potentializes the sealing effect of the sealing lip. Additionally, the relative rigidity of the annular support brings about the centering of closure with respect to the bottle-neck during its application, at the moment of packing the beverage. Evidently, this centering occurs whenever the closure is screwed onto the bottle-neck again, after successive openings.

The closure disclosed in this patent further comprises an anti-taper seal that functions in the manner described above.

However, due to the fact that the closure has only this side sealing achieved by the above-mentioned elements, the effective protection against leakage of gas still had not been achieved, notably when the filled bottle was subjected to unfavorable situations, such as high temperatures and excessive manipulation.

Another single-piece closure, now made by the applicant itself, is disclosed in patent document MU 7600036-2 and comprises a first circular surface, from the end of which a cylindrical wall extends. This closure has at least one first axial sealing element cooperating with the inner surface of the bottle-neck, at least one second axial sealing element cooperating with the upper surface defined by the wall of the bottle-neck and, finally, at least one third radial sealing element, provided on the inner surface of the side wall and cooperating with the outer surface of the bottle-neck. This closure also has an anti-tamper seal.

Although the closure disclosed in this document functions well under normal conditions, an excessive increase in pressure inside the bottle causes the upper circular surface to deform, a bulging or "belly" resulting. When this surface is deformed, the possibility of occurring leakages increases.

BRIEF SUMMARY OF THE INVENTION

The present invention has the objective of providing a single-piece closure, particularly for use on containers/bottles for packing liquid products, preferably carbonated beverages, which has great tightness, that is to say, it is capable of preventing leakage of gas or liquids, and has a configuration that renders difficult the deformation of the top circular surface of the closure, with a view to maximize its tightness and to improve its appearance, thus guaranteeing the trust of the consumer with respect to the beverage packed in the bottle/container, keeping the manufacturing cost reduced.

It is also an objective of the present invention to provide a container for packing products that use the closure proposed now.

The objectives of the present invention are achieved by means of a closure, particularly for use on containers for packing liquid products, which comprises a fist substantially circular portion, from the end of which a second substantially cylindrical portion extends and is substantially orthogonal to the first portion, the closure comprising a sealing system provided with a first sealing element associated to the first portion and second and third sealing elements associated to the second portion, the first, second and third sealing elements cooperating with the packing container;

the first and third sealing elements providing sealing by deformation when the closure is associated to the container;

the second sealing element providing sealing by direct compression when the closure is associated to the container.

Also, the objectives of the present invention are achieved by means of product-packing container, particularly for packing liquid products, comprising a closure provided with a first substantially circular portion, from the end of which a second substantially cylindrical portion extends and is orthogonal to the first portion, characterized in that the closure comprises a sealing system provided with a first sealing element associated to the first portion and second and third sealing elements associated to the second portion, the first, second and third sealing elements cooperating with the container;

the first and third sealing elements providing sealing by deformation;

the second sealing element providing sealing by direct compression.

The present invention presents, as an advantage, a single-piece closure having great resistance under high internal pressures, guaranteeing tightness against leakage of gas and liquid products, in addition to restricting the bulging of the upper portion. Another great advantage is that this desired increase in resistance to leakage and to bending does not result in an increase in the manufacturing costs of the closure, providing a great penetration into the market.

BRIEF DESCRIPTION OF THE DRAWINGS

The present invention will now be described in greater details with reference to an embodiment represented in the drawings. The figures show.

DETAILED DESCRIPTION OF THE INVENTION

Figure 1:
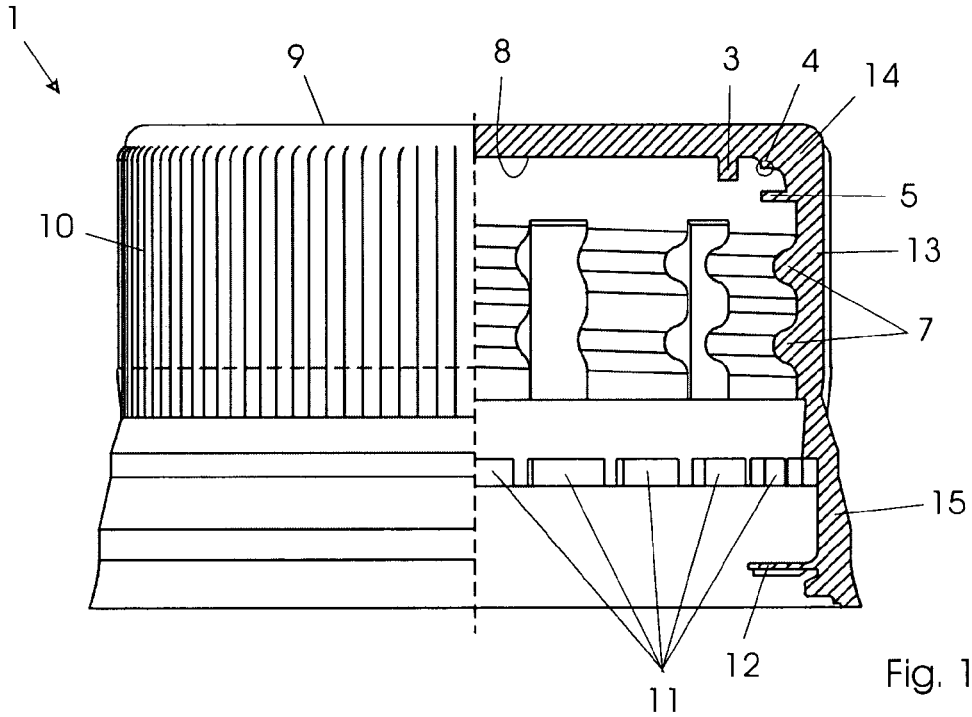
FIG. 1 is a side partial cross-sectional view of the closure of the present invention.

According to a preferred embodiment and as can be seen in FIG. 1, the closure 1 of the present invention is composed of a first and a second portions 9, 13 directly associated to each other, a sealing system and a tamper-indicating system. The present closure 1 is made in a single piece, as will be shown bellow, and is made from a plastic material shaped by injection, although other necessary or desirable manufacturing methods and materials may be used, without the resulting closure departing from the protection scope of the present invention.

The closure 1 described now is intended to be used preferably on containers for packing carbonated beverages, such as soft drinks, which have a large amount of gas dissolved therein, a characteristic that creates a great pressure inside the container that holds them, requiring a closure that has great resistance to high pressures.

Structurally, the closure 1 comprises a first substantially circular portion 9, from the end or periphery of which a second substantially cylindrical portion 13 extends, in such a way that the second portion 13 is substantially orthogonal to the first portion 9.

Evidently, one can conceive a closure in accordance with the teachings of the present invention, wherein said first and second portions have other shapes that were not mentioned above, as long as they result in a functional closure.

Therefore, the closure 1 has a substantially cylindrical shape, with a closed end corresponding to that occupied by the first portion 9, and an open end defining an internal cavity or the inside of the closure to enable it to be mounted onto a container for packing products, preferably liquid products, this container having a neck 2.

Both first and second portions 9, 13 define respective outer surfaces facing outwards of the closure 1, and inner surfaces facing inwards of the cavity defined by the closure 1.

In the preferred embodiment, the closure 1 is screwed onto the container neck and comprises at least one first thread 7 cooperating with a second analogous thread 7' provided on the container neck 2.

More preferably, the first thread 7 actually comprises a plurality of consecutive segments, but this particular construction may vary, as long as the thread or threads enable the closure to be correctly screwed onto the neck 2. The latter, in turn, may present the same possibilities of amount and arrangement of its second threads 7', as long as they cooperate with the first threads 7 of the closure 1.

Evidently, other elements that are not composed of threads may be provided for locking the closure 1 onto the container neck 2, as long as they bring about the correct locking between both, configuring a closure 1 effective against leakage.

In addition to the first and second portions that configure the closure 1 structurally, the latter also comprises a sealing system that effectively prevents leakage of gas or liquid from the product packed in the container.

The sealing system comprises a first sealing element 3, a second sealing element 4 and a third sealing element 5.

The first sealing element 3 comprises a resilient sealing ring, which extends from the inner surface 8 of the first portion 9, being substantially concentric to it. The resilient ring 3 has a substantially rectangular cross-section, but evidently this shape may vary, as long as it enables the ring 3 to be functional.

The resilient sealing ring 3 has a first side surface facing the second portion 13 of the closure, a second side surface opposed to the first one, and a third lower surface that is substantially parallel to the direction of the longitudinal length of the ring 3 and substantially parallel to the plane defined by the first portion 9.

Also, the resilient ring 3 may have other shapes (as for example, elliptical or segmented), as long as they cooperate with the shape of the first portion 9 and of the neck 2, in order to provide the sealing.

Since the resilient ring 3 projects from the inner surface 8 of the first portion 9, it is an integral part of the closure, instead of being applied onto it later.

The second sealing element 4, in turn, comprises an annular stop that projects radially from the inner surface of the second portion 13 of the closure 1. This annular stop 4 has a first upper surface cooperating with the first portion 9 of the closure 1, so as to provide the closure 1 of the present invention with a great structural rigidity to bear the pressures existing inside the container that it closes, without presenting any considerable deformation, a second side surface facing the internal cavity of the closure, and further a third back surface opposed to the first upper surface. As the name itself indicates, since the second sealing element 4 is a stop, it is not resilient, that is to say, it undergoes virtually no deformation when the closure 1 is screwed onto the container neck 2.

The annular stop 4 of the closure 1 of the present invention has a substantially trapezoidal cross-section, but it is evident that its cross-section may assume any other shapes, as long as they allow the resultant stop 4 to be resistant to deformations caused by compression. Due to the fact that it projects from the side portion 13 of the closure 1, it is an integral part of the closure, instead of being applied onto it later.

Finally, the third sealing element 5 comprises a substantially resilient annular sealing lip, which projects radially from the inner surface of the second portion 13.

The annular sealing lip 5 has a first upper surface facing the first portion 9 of the closure 1, a second side surface facing the inside of the closure 1 and a third back surface opposed to the first one. The cross-section of the annular sealing lip 5 is substantially rectangular, but it is evident that this shape may vary, as long as it enables the lip to be functional. Once more, due to the fact that the lip 5 projects from the inner surface 8 of the first portion 9, it is an integral part of the closure.

As already mentioned before, the closure 1 of the present invention is designed to close containers having a neck 2, preferably cylindrical, but it may have any other shape, as long as it cooperates with the first and second portions 9, 13 of the closure 1.

The neck 2, which is cylindrical in the preferred embodiment, has a first inner surface 2', a second outer surface 2" and a third upper surface 6, which faces the first portion 9 of the closure 1 when associated to the neck 2.

The second outer surface 2" has at least a second thread 7', as already mentioned, which should cooperate with the first thread 7 of the closure 1. On the other hand, the third upper surface 6 defines a substantially plane ring corresponding to the cross-section of the neck 2.

Evidently, the neck 2 may exhibit any other variations not foreseen in this specification, since this is not the objective of the present invention. The single requirement with regard to the neck 2 is that it should cooperate with any closure 1 whatever that is included in the protection scope of the accompanying claims, for the purpose of sealing the container to prevent leakage of the gas or the liquid proper contained therein.

The closure 1, upon being screwed onto the neck 2, which is not deformable, brings about the sealing by cooperation of the sealing elements and the neck, as describes in greater detail later.

Figure 2:
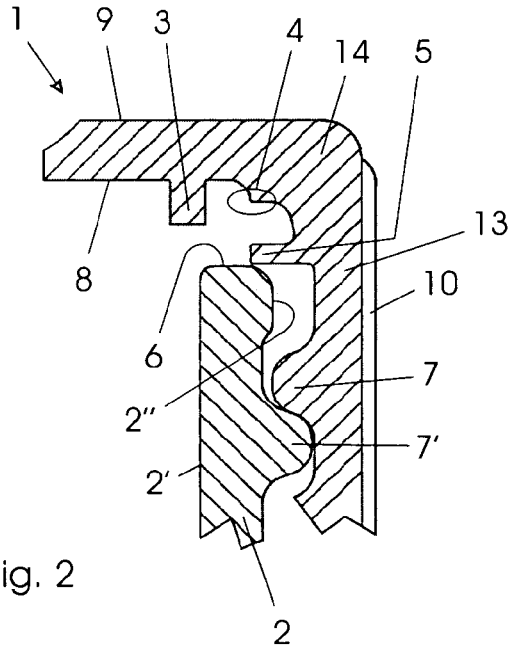
FIG. 2 is a cross-sectional view of the closure of the present invention at the moment preceding its placing onto the container having a neck.

As can be seen in FIG. 2, when one start screwing the closure 1 onto the neck 2, the cooperation between the first and second threads 7, 7' begins. At this first moment, there is no cooperation between any of the three sealing elements 3, 4, 5 with the neck 2, so that leakage of both the liquid product and the gas may occur.

Figure 3:
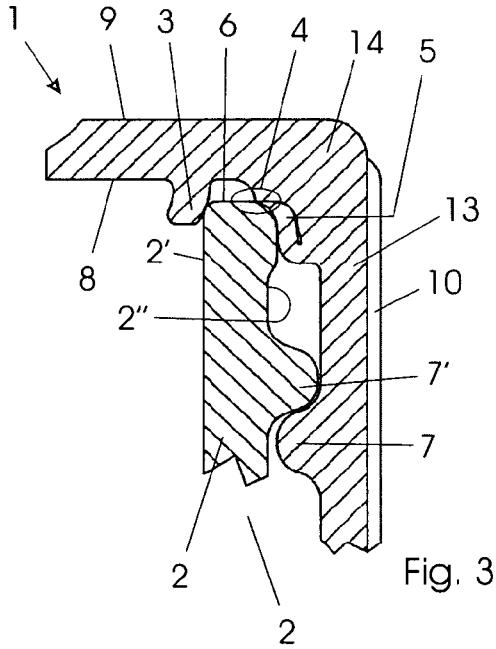
FIG. 3 is a cross-sectional view of the closure of the present invention after it has been placed onto the container having a neck.
Figure 4:
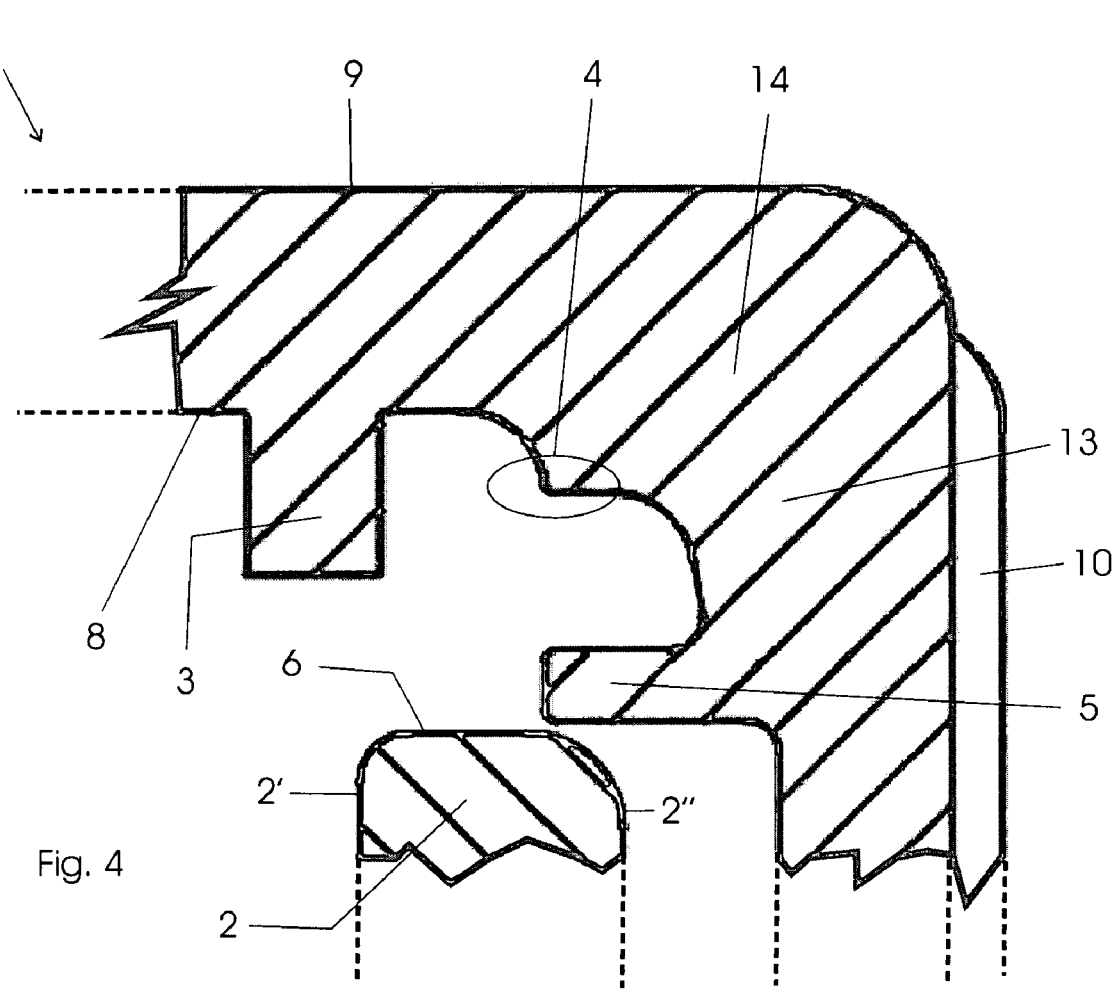
FIG. 4 is a detailing of the cross-sectional view illustrated in FIG. 2.

FIG. 3 discloses the closure 1 of the present invention already threaded on the neck 2. As can bee seen, this threading has caused deformation of the first and third sealing elements 3, 5.

When the closure 1 is threaded onto the neck 2, the resilient sealing ring 3 meets this neck (which is undeformable) and is deformed in the direction of the center of the first portion 9. Since the ring 3 has been deformed, it applies on the first inner surface 2' of the neck 2 a force perpendicular thereto, which result from its tendency to return to its original position.

This perpendicular force, which is a component that causes friction force between them both, maximizes the sealing, preventing gas and liquid from passing through this region, where the contact between the inner surface of the neck 2' and the second side surface of the resilient ring 3 occurs.

It should be noted that the deformation of the resilient sealing ring 3 is not permanent, that it so say, when the closure 1 is unscrewed from the container neck 2, it returns to its rest position and is again deformed when the closure 1 is screwed onto the neck 2 once more. Therefore, the first sealing described above enables the partial consumption of the product contained inside the container.

The end of the path of the screwing of the closure 1 onto the neck 2 of the product-packing container occurs when the upper surface 6 of the latter cooperates with the annular stop 4, touching it due to the fact that both the neck 2 and the stop 4 are undeformable. The sealing at this point is guaranteed by the force component applied between them both, due to the direct compression caused by the screwing, which is perpendicular to the region defined by the touch between them, generating a friction force that prevents the passage of gas or liquid product. This second sealing, in conjunction with the first one, increases the safety of the closure 1 against leakage, even in the case of the container presenting high internal pressures. The arrangement and the shape of the annular stop also influence drastically the capability of deforming the first portion 9, as will be described later, this being one of the great advantages of the closure proposed now in comparison with those of the prior art.

Also, this second sealing is undone when the closure 1 is unscrewed from the neck 2. However, when the closure is again screwed on, the cooperation between the annular ring 4 and the neck upper surface 6 occurs once more, thus ensuring the partial consumption of the product and the maintenance of the sealing, in order to guarantee the quality of the remaining product.

At the same time when deformation of the resilient sealing ring occurs, the substantially resilient sealing lip 5 is deformed, also for the purpose of sealing. As the closure 1 is screwed onto the neck 2, the outer surface 2" of the latter, which is undeformable, causes deformation of the lip 3, which opens upwards, in such a way that its upper surface touches the inner surface of the second portion 13, and its back surface touches the outer surface 2" of the neck. In this way, the deformed lip 5 applies onto the outer surface 2" of the neck 2 a force perpendicular to it, which results from its tendency to return to its original position, and provides the third sealing between both surfaces. It should be further noted that the deformation of the lip 5 is not permanent either, that is to say, when the closure 1 is unscrewed from the container neck 2, it returns to its rest position and is deformed once more when the closure 1 is screwed onto the neck 2 again.

The three sealings described above enable the closure 1 of the present invention to be capable of bearing a high internal pressure, without leakages, which often occur in the case of containers for packing carbonated beverages such as soft drinks, which has a dramatic increase in internal pressure when they are abruptly shaken and/or when they are subjected to a higher temperature. These situations that frequently occur together during transportation, which, as a rule, is carried out on open trucks, which expose the bottles to the sunshine.

In the case of the closures of the prior art, as already mentioned, due to the excessive internal pressure that occurs in determined situations, the respective upper parts may exhibit a convex bulging outwards, which, although it does not lead to a leakage of gas or liquid product, may lead to suspicions of the consumers with regard to the quality or state of the product contained in the container/bottle.

The closure 1 of the present invention has an improvement in comparison with the closures of the prior art with respect to this problem, since its constructive geometry favors the balance of tensions resulting from the internal pressure, and so it exhibits little bulging, even in situations considered critical in terms of internal pressures.

The favorable geometry is achieved by means of the positioning and the shape of the annular sealing stop 4. As already stated, it projects from the second portion 13 of the closure 1 and has a first upper portion cooperating with the internal surface of the first portion 9. In this way, in the region 14 (which is annular) of the portion 9, where this cooperation takes place, the thickness of the material is considerably larger than in the rest of the closure 1. In addition, this annular region of large thickness 14 delimits an internal area (which corresponds to the largest part of the first portion 9), in which the thickness is significantly smaller, in order to get lower the manufacturing cost of the closure 1.

When the internal pressure of the container/bottle equipped with the closure disclosed now increases too much, there would be a natural tendency of the whole closure to become deformed due to the bulging of the first portion. Once the bulging occurs, this surface, which was circular before, would become semispherical, resulting in a decrease in its diameter, which, in turn, causes a decrease in diameter of the second cylindrical portion. However, the free end of this second portion, where an anti-tamper system is provided (which will be commented later), would not undergo any change, and so this second portion would tend to have the shape of a truncated cone.

With the present closure, this does not occur, since the large amount of material in the region of large thickness prevents its diameter from decreasing.

Figure 5:
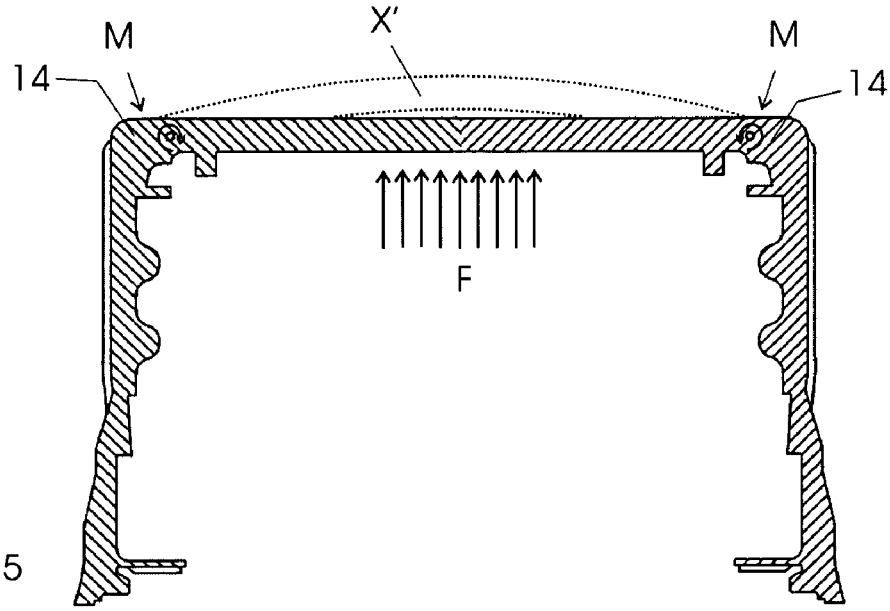
FIG. 5 is a schematic cross-sectional view of the closure of the invention under the influence of pressure inside the container.

As can be seen in FIG. 5, the internal pressure of the package tends to bulge the top part of the closure to a position indicated by X' in the drawing. With the tendency of this upper portion to deform, a bending moment occurs in the large-thickness region 14, forcing the deformation. However, due to the large amount of material in the region 14, it exerts a bending moment in the opposite direction (illustrated with M in the figure), which greatly limits this deformation X'. The constructive characteristic of the present closure, which has a large-thickness region 14, brings two practical effects, namely:

first of all, as already stated, there is a considerable increase in the resistance of the closure 1 to the deformation of its upper portion; and secondly, this so much desired increase in resistance to bending does not result in an increase in the manufacturing costs of the closure, since the increase in material is localized, representing little with respect to the total mass.

In short, the closure proposed now has a great resistance to bending in comparison with the closures of the prior art and has the same manufacturing cost, thus being advantageous, chiefly when one considers that the production cost per unit of a closure is very reduced, and any increase in cost, even if it is low, has a great impact in terms of percentages.

In order to facilitate the handling thereof, to unscrew it from the neck 2 and to screw it thereon, the closure 1 is provided with a plurality of vertical crease projections 10, located on the outer surface of the second cylindrical portion 13. The projections 10 are substantially elongated in shape and increase the friction between the consumer's hand and the closure 1, thus bringing about a better use of the force to handle it. Evidently, these projections 10 may vary in shape and number, as well as they may even be omitted.

The closure 1 of the present invention preferably presents the already mentioned anti-tamper system 15, the function of which is to prevent it from being opened without the weakened lines being broken, which indicates that it has been opened. This system or seal guarantees to the consumer that the bought products has not been manipulated by thirds or exposed to the outer environment.

The anti-tamper system comprises a plurality of frangible regions 11, the thickness of which is considerably smaller than that of the rest of the second portion 13, which are located in an intermediate portion of the latter, closer to the opening of the closure, that it, in its lower part.

These frangible regions 11 are arranged so as to form a ring dividing the portion 13 into an upper part and a lower annular segment 15, which corresponds to its free end region.

In addition, the lower annular segment 15 comprises a plurality of tab stretches 12, which project from its inner surface and have the property of being totally bent upwards and, at the same time, do not have flexibility to be bent downwards.

Therefore, when the closure 1 is unscrewed form the neck, the impossibility of bending the tab stretches 12 downwards cause them to interfere with the neck 2; so the lower annular segment 15 tends to remain on the neck. Thus, if one continues to screw the closure 1, the rupture of the frangible regions 11 occurs, which indicates that the container has been opened.

On the other hand, since the tab stretches 12 can be totally bent upwards, the closure 1 may easily be inserted while the container is being filled in the factory, without presenting rupture of the frangible regions 11.

Evidently, the anti-tamper system described herein refers to a preferred embodiment, and so it may present variations in one or more of its components, or else it may not be provided.

A preferred embodiment having been described, it should be understood that the scope of the present invention embraces other possible variations, being limited only by the contents of the accompanying claims, which include the possible equivalents.

The invention claimed is:

1. A closure for application to a neck of a container for liquids, wherein the container neck has a first inner surface, a second outer surface, and a third upper surface, the closure comprising:

a substantially circular first portion having an outer periphery from which a substantially cylindrical second portion projects, the first portion having a lower surface, the second portion being substantially orthogonal to the first portion and having an inner surface that faces the second outer surface of the neck of the container when the closure is applied thereto, a juncture between the first and second portions being substantially thicker than the rest of the closure; and a sealing system integrally formed with the closure, the sealing system comprising:

a first sealing element projecting from the lower surface of the first portion and having a first side surface facing the second portion and positioned to be engaged by the container neck when the closure is applied thereto, the first sealing element being resiliently deformable by the neck;

a second sealing element projecting from the juncture between the first and second portions and positioned to be directly contacted by and compressed against the third upper surface of the container neck when the closure is applied thereto, the second sealing element comprising an annular ring that resists reduction in diameter of the second sealing element caused by internal pressure exerted on the first portion and thereby exerts a bending moment on the first portion opposite to that caused by the internal pressure in order to limit outward bulging of the first portion of the closure; and a third sealing element projecting from the inner surface of the second portion and having a lower surface facing away from the first portion, the lower surface of the third sealing element being positioned to be contacted by the container neck when the closure is applied thereto, the third sealing element being resiliently deformable by the neck.

2. A closure according to claim 1, wherein the first sealing element comprises a resilient sealing ring that projects from the first portion in a substantially concentric way.

3. A closure according to claim 2, wherein the resilient sealing ring has a first side surface facing the second portion, a second side surface opposed to the first side surface, and a third lower surface, which is substantially perpendicular to the direction of length of the ring.

4. A closure according to claim 3, wherein the resilient sealing ring has a substantially rectangular cross-section.

5. A closure according to claim 1, wherein the annular ring has a substantially trapezoidal cross-section.

6. A closure according to claim 1, wherein the third sealing element comprises a substantially resilient annular sealing lip.

7. A closure according to claim 6, wherein the annular sealing lip has a substantially rectangular cross-section.

8. A closure according to claim 1, wherein the closure comprises at least a first thread located on the inner surface of the second portion.

9. A container for packing liquid products, the container having a neck defining a first inner surface, a second outer surface, and a third upper surface, and further comprising a closure according to claim 1 engaged with the neck.

10. A container according to claim 9, wherein the first sealing element of the closure comprises a resilient sealing ring, which projects from its first portion in a substantially concentric way.

11. A container according to claim 9, wherein the third sealing element of the closure comprises a substantially resilient annular sealing lip.

12. A container according to claim 9, wherein the closure comprises at least one first thread, located on the inner surface of the second portion.

13. A container according to claim 9, wherein the neck is provided with at least one second thread located on an outer surface of the neck.

* * * * *